United States Patent [19]

Yokoyama

[11] Patent Number: 4,773,248

[45] Date of Patent: Sep. 27, 1988

[54] PROCESS FOR MANUFACTURING A PART HAVING A TOOTH PROFILE AND BOSS

[75] Inventor: Michihiro Yokoyama, Anjo, Japan

[73] Assignee: Kabushiki Kaisha Yokoyama Seisakusho, Anjo, Japan

[21] Appl. No.: 77,201

[22] Filed: Jul. 24, 1987

[30] Foreign Application Priority Data

Feb. 5, 1987 [JP] Japan ..... 62-25422

[51] Int. Cl.[4] ..... B21D 22/00

[52] U.S. Cl. ..... 72/343; 29/159.2; 72/329; 72/359

[58] Field of Search ..... 72/329, 336, 343, 359; 29/159.2

[56] References Cited

U.S. PATENT DOCUMENTS

| | | | |
|---|---|---|---|
| 3,258,834 | 7/1966 | Rork | 29/159.2 |
| 3,688,549 | 9/1972 | Ohnishi et al. | 29/159.2 |
| 3,694,127 | 9/1972 | Takahashi et al. | 29/159.2 |
| 4,509,353 | 4/1985 | Ike et al. | 72/343 |
| 4,672,729 | 6/1987 | Hoguchi et al. | 29/159.2 |

FOREIGN PATENT DOCUMENTS

| | | | |
|---|---|---|---|
| 16831 | 10/1962 | Japan | 29/159.2 |
| 49-79945 | 8/1974 | Japan . | |
| 55-141348 | 11/1980 | Japan . | |
| 57-14439 | 1/1982 | Japan . | |
| 58-47929 | 10/1983 | Japan . | |
| 59-76639 | 5/1984 | Japan . | |
| 261638 | 12/1985 | Japan | 29/159.2 |

*Primary Examiner*—W. Donald Bray

*Attorney, Agent, or Firm*—Burns, Doane, Swecker & Mathis

[57] ABSTRACT

The present invention relates to a process for the manufacture of parts having a tooth profile and boss by means of a press machine. The process of the present invention comprises a blank with a boss, which is produced in a prior operation by machining, cold forging, warm forging or other method, being positioned on a female die having a tooth profile formed thereon on a mirrored surface, said female die having a 20°–150° taper at its inlet, and having a shape conforming to the bottom configuration of said blank, and wherein an ironing process is performed by means of a punch having a shape conforming to the top configuration of said blank.

5 Claims, 7 Drawing Sheets

PROCESS FOR MANUFACTURING A PART HAVING A TOOTH PROFILE AND BOSS

BACKGROUND OF THE INVENTION

The present invention relates to a process for manufacturing, by means of a press machine, a spur gear, a driving gear having an optionally shaped tooth profile, or other part having a tooth profile and boss.

DESCRIPTION OF THE PRIOR ART

A part having a tooth profile also commonly has a boss and in conventional manufacturing of such a part having both a tooth profile and a boss by cold-press forming, for example as per the process disclosed in Tokko Sho No. 58-47929, stretch-forming is performed using a finishing die following extrusion molding using a rough-forming die, and a forming process is performed wherein the tooth profile of the finishing die conforms to the major diameter of the work blank, but in such processes a large-scale press machine is required, the major diameter of the punch to which high pressure is applied becomes worn within a short period, and a toothed part having the required quality cannot be manufactured over a long period, there being a severe limitation upon the useful life span of the punch. Furthermore, processes employing precision punch-presses require expensive, specialized press machines, the useful life span of the punches used in such machines is limited, and a degree of closure is produced on the top and bottom of the toothed part.

SUMMARY OF THE INVENTION

An object of the present invention is to provide a process wherein a part having both a tooth profile and boss can be manufactured without using a specialized, large-scale or expensive press machine.

A further object of the present invention is to provide a process wherein a part having both a tooth profile and boss can be manufactured while extending the useful life span of the punch and female die.

A still further object of the invention is to provide a process wherein a part having both a tooth profile and boss can be manufactured with the required quality.

The present invention provides a process for manufacturing parts having a toothed profile and boss comprising a blank with a boss which is produced in a prior operation by machining, cold forging or warm forging, said part with boss being positioned on a female die having a tooth profile formed thereon on a mirrored surface, said female die having a 20°–150° taper at its inlet, and having a shape conforming to the bottom configuration of said blank, and wherein an ironing process is performed by means of a punch having a shape conforming to the top configuration of the aforesaid blank.

According to the aforesaid construction, the press forming pressure applied to the punch and female die is reduced because the blank with boss is produced in an earlier operation by machining, cold forging or warm forging, thus extending the useful life span of said punch and female die, as well as making it difficult for cracks to occur in the toothed part. Since the punch is provided with a shape which conforms to the top configuration of the blank with boss, it is effective in producing an adequate flow of the form thickness in the direction of the teeth. Friction generated in the contact of the blank and the female die is reduced due to the provision of a taper at the inlet to the female die and due to the mirrored surface provided to improve sliding, the rough surface of the toothed part thus becoming smooth. Also, the blank can be processed at a reduced forming pressure applied to the punch and female die because the press-forming pressure is dispersed by the taper, and the useful life span of the punch is further extended by the reduction of the pressure exerted by the punch on the surface in opposition.

Under the conditions of the first embodiment of the present invention, the aforesaid punch is provided with a tooth profile. According to the stated conditions, when the clearance between the punch and the female die is minimal, punch debris from the blank at the bottom of the punch is ejected and a suitable tooth profile is formed on the blank because the shape of the punch itself conforms to the minor diameter shape of the female die which is provided with a tooth profile.

Under the conditions of the second embodiment of the present invention, the aforesaid blank has the trimming taper removed therefrom by means of reversing the top-to-bottom orientation of the blank following an ironing operation wherein a second stamping operation is performed on said blank. In the present invention, a trimming taper is produced on the blank on the underside by the female die and on the top by the punch because the inlet to the female die has a taper provided thereon. Toothed parts which do not require high precision forming can be completed in a single stamping operation comprising a single combined cycle of descending and ascending strokes of the press. However, because the trimming taper which reduces part precision must be removed in order to produce high precision toothed parts, said trimming taper is removed by means of reversing the top-to-bottom orientation of the blank 180° and performing the stamping operation a second time. In such a case, the present invention has the advantage of effectively improving forming precision because all trimming taper is removed from the interior minor diameter, major diameter, and pitch circle produced by the female die by means of the stamping process.

Under the conditions of the third embodiment of the present invention, the aforesaid punch is a round punch having no tooth profile formed thereon. According to the stated conditions, when the toothed part requires a modular or fine tooth profile the present invention has the advantage of extending the useful life span of the punch by employing a round punch in the process.

Under the conditions of the fourth embodiment of the present invention, the aforesaid punch does not have a tooth profile formed thereon and an excess thickness recess is provided on the counter and said punch. Even in the case of parts production using a punch having a tooth profile formed thereon, buildup will be produced on the punch side at the clearance between the punch and the female die, or excess thickness will be produced. The excess thickness and buildup which are thus produced can be removed in a secondary process by means of a machining or grinding process, but when a greater degree of precision is required, the trimming taper is removed in a secondary stamping process as described in the conditions of the aforesaid second embodiment. When a toothed part having excess thickness, excluding buildup, undergoes a secondary stamping process, it is desirable to provide beforehand an excess thickness recess in the counter and punch in order to allow a reduction in the press-forming pressure.

Other and further objects, features and advantages of the invention will become more fully apparent from the following description.

DETAILED DESCRIPTION OF THE PREFERRED EMBODIMENTS

Embodiments of the present invention are hereinafter described with reference to the drawings.

Figure 1A:
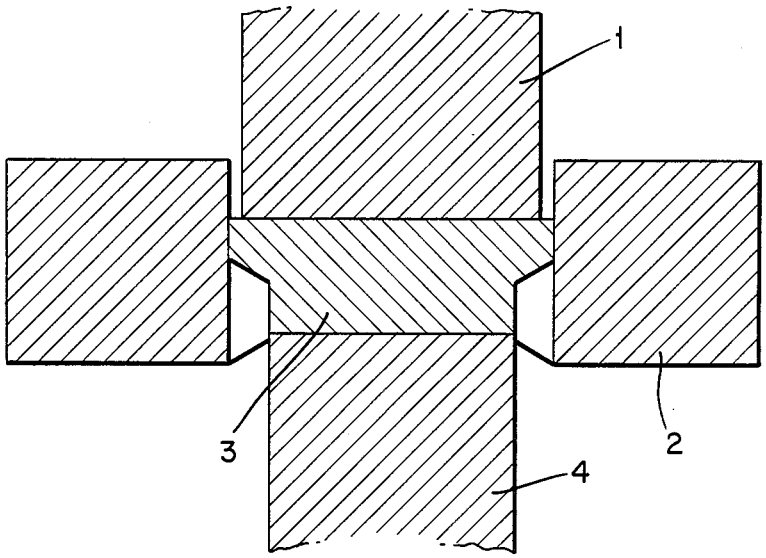
FIGS. 1(A) and 1(B) are a cross sectional view and an explanatory drawing, respectively, which show the basic structure of the press machine used in an embodiment of the present invention.
Figure 1B:
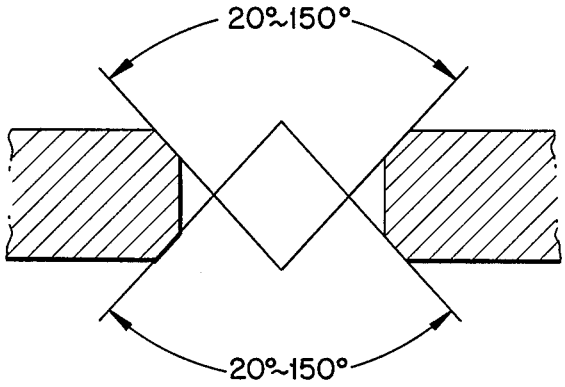
Figure 2:
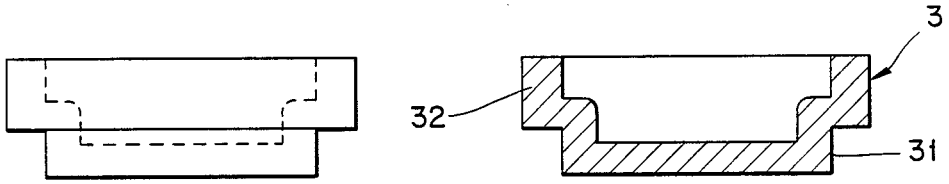
FIGS. 2(A), 2(B) and 2(C) are frontal elevation and cross sectional views showing the shapes of the blank with boss.
Figure 2:
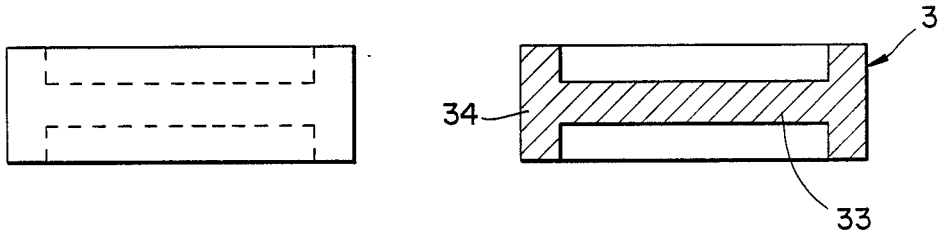
Figure 2:
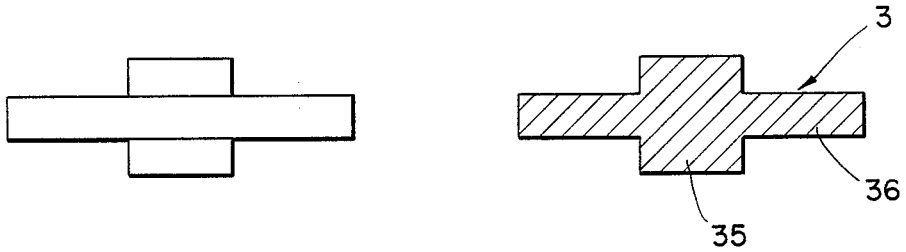
Figure 3A:
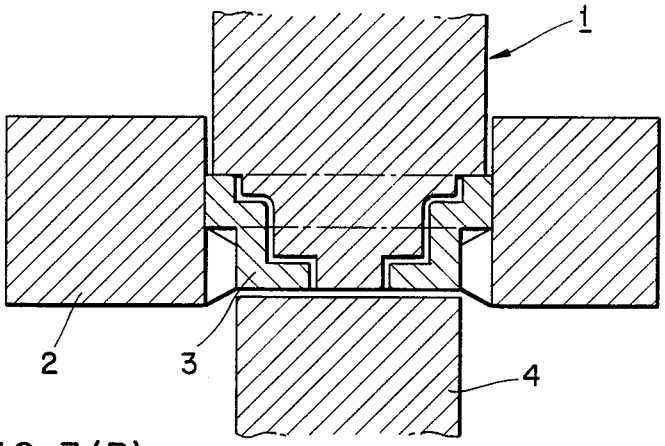
FIGS. 3(A), 3(B) and 3(C) are cross sectional views which respectively show the structures needed for stamping different shaped blanks with bosses.
Figure 3B:
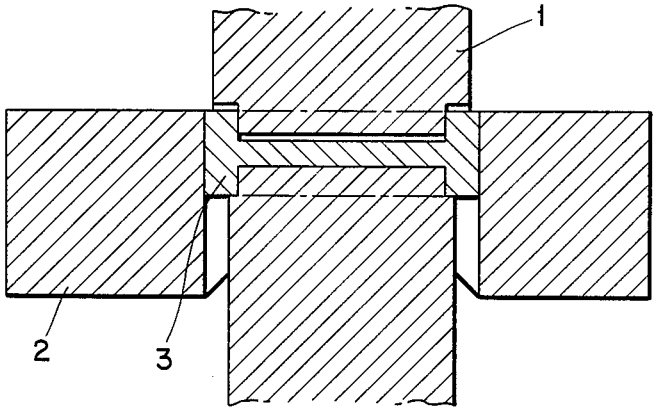
Figure 3C:
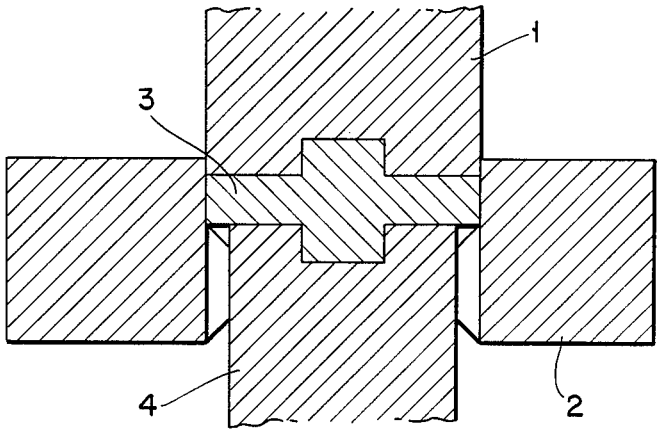

The basic structure of a press machine using the processes of the present invention is shown in FIGS. 1(A) and 1(B). The press machine in the present embodiment comprises a punch 1, a female die 2 and a counter 4. As shown in FIGS. 3(A), 3(B) and 3(C), punch 1 is formed in a shape conforming to the top configuration of blank-with-boss 3. The tooth profile inlet of female die 2 has a 20°–150° angle taper provided thereto as shown in FIGS. 1(A) and 1(B) as well as a mirrored surface provided to improve sliding characteristics. Counter 4 pushes the press-formed blank-with-boss 3 from a downward direction, extruding said blank-with-boss 3 toward the top of female die 2. A blank with a shape substantially that of the finished product is produced in a prior operation by machining, cold forging or warm forging as shown in FIGS. 2(A), 2(B) and 2(C). As shown in FIG. 2(A), blank-with-boss 3 forms a dish-shaped cross section with a projecting section 31 comprising the boss and an annular body 32 having an exterior surface with a tooth profile stamped thereon. As shown in FIG. 2(B), blank-with-boss 3 forms an H-shaped cross section with a tabular section 33 comprising the boss and an annular section 34 having an exterior surface with a tooth profile stamped thereon. As shown in FIG. 2(C), blank-with-boss 3 forms a cruciform cross section with a central axial section 35 comprising the boss and a circular plate 36 having an exterior surface with a tooth profile stamped thereon.

Figure 7A:
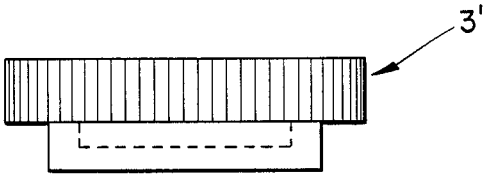
FIGS. 7(A)–7(C) are frontal elevation views showing the parts with tooth profile and boss.
Figure 7B:
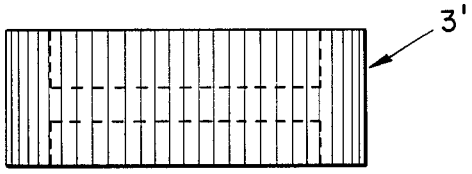
Figure 7C:
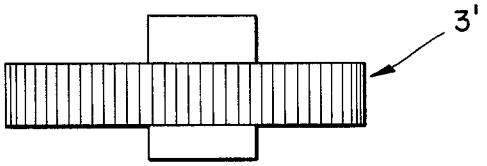

The configuration of punch 1 itself, which is not shown in FIG. 1(A), comprises a tooth profile on its exterior surface, said tooth profile configuration conforming to the minor diameter configuration of female die 2. The configuration of the bottom of punch 1 is formed so as to conform to the top configuration of the aforesaid blank-with-boss 3, and in the case where blank 3 forms a dish-shaped cross section as shown in FIG. 3(A), the bottom configuration of said punch 1 comprises an inverted convexity having a projection provided thereon for stamping the shaft hole. When blank 3 forms an H-shaped cross section as shown in FIG. 3(B), the bottom configuration of punch 1 comprises a projection, and when a shaft hole and mounting hole are stamped on circular plate 33, additional projections for stamping said shaft and mounting holes are provided, however, these projections are not shown in the drawing. In the case where blank 3 forms a cruciform cross section as shown in FIG. 3(C), the bottom configuration of punch 1 comprises an inverted concavity. The configuration of a toothed part-with-boss 3' is shown FIGS. 7(A), 7(B) and 7(C).

[Operation]

In the manufacture of a toothed part-with-boss 3' by means of a press machine of the aforesaid construction, punch 1 and female die 2 have a blank-with-boss 3, which is produced in a prior operation, of the shape shown in FIGS. 2(A), 2(B) and 2(C) provided therebetween, said punch 1 being forced in a downward direction. In the case where the clearance between punch 1 and female die 2 is minimal, debris from blank 3 at the bottom of punch 1 is ejected. The bottom configuration of punch 1 conforms to the top configuration of blank 3 and the form thickness of said blank 3 adequately flows in the tooth direction because no spacing is provided between punch 1 and blank 3. Blank 3 transits female die 2 with minimal frictional resistance and the surface of toothed part 3' is formed smoothly because the inlet to female die 2 has a 20°–150° taper as well as a mirrored surface provided thereon. The angle of the taper provided at the inlet of female die 2 may vary according to the thickness of said blank 3, and an appropriate angle in the range of from 20°–150° may be determined by experimentation. The present invention provides the advantage of further extending the useful life span of the die because minimal pressure is exerted by punch 1 on the surface in opposition. This condition occurs because the stamping process may be performed at reduced pressure between female die 2 and punch 1 since the press pressure of punch 1 is dispersed by the aforesaid taper.

According to the basic structure as shown in FIG. 1, a trimming taper is produced on blank 3, by female die 2 on the bottom and by punch 1 at the top, because a taper is provided at the inlet to said female die 2, said blank 3 as a whole forming an inverted trapezoid. Toothed parts which do not require high precision formation can be completed in a single stamping operation comprising the single combined cycle of descending and ascending strokes of the press. However, in the manufacture of high precision toothed parts, the trimming taper, which reduces the precision of said parts, must be removed as appropriate for the required quality. To achieve this aim, the top-to-bottom orientation of blank 3 is reversed, and the trimming taper of said blank 3 is removed by means of counter 4 and punch 1 which conform to the configuration of said reversed blank 3. In such a case, the present invention effectively removes, by means of the stamping process, all trimming taper from interior minor and major diameters and the pitch circle formed by female die 2.

[Further Embodiments]

Figure 4A:
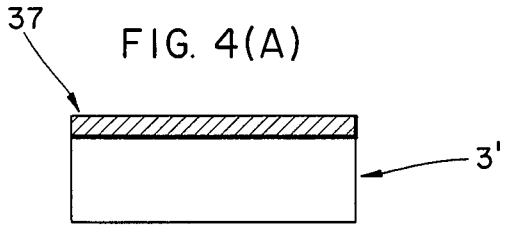
FIGS. 4(A), 4(B) and 4(C) are schematic frontal elevation views showing, as other embodiments of the present invention, parts having tooth profiles produced by a stamping process using a round punch.
Figure 4B:
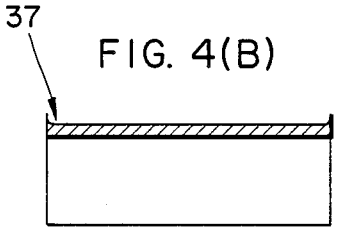
Figure 4C:
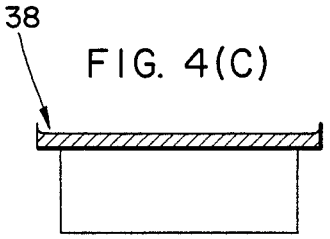
Figure 5:
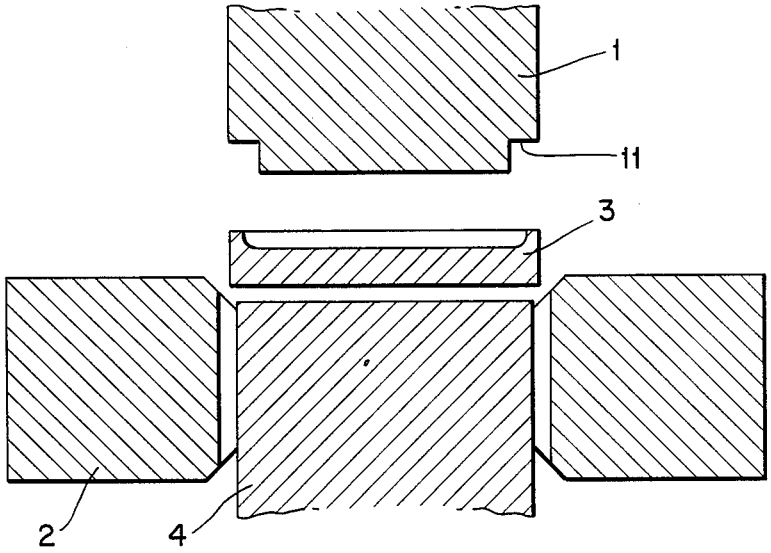
FIGS. 5(A) and 5(B) are cross sectional views showing the structures wherein excess thickness recesses are provided in the dies used for the secondary stamping process.
Figure 5:
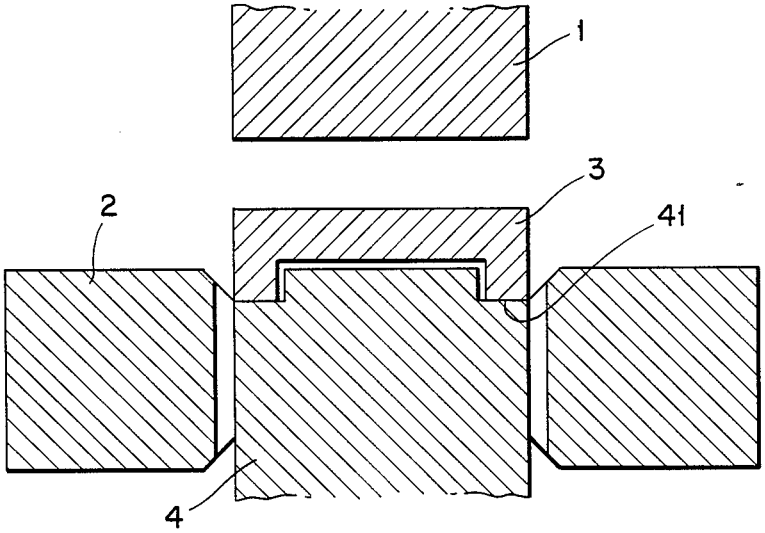

In a case where the tooth profile is modular or fine, a round punch having no tooth profile on its exterior surface is used as the punch 1 in order to extend the useful life span of said punch 1. When a round punch is used, excess thickness 37 or buildup 38 occurs on the punch side of toothed part 3' as shown in FIGS. 4(A-)-4(C) because the clearance between said punch 1 and female die 2 is increased. When excess thickness 37 is produced the major diameter of toothed part 3' remains unchanged, but when buildup 38 is produced the diameter of toothed part 3' is greater than normal. Excess thickness 37 or buildup 38 can be removed in a secondary process of machining or grinding. Also, when a higher degree of precision is required similar to that of trimming taper removal, it is desirable to perform a secondary pressing operation on the toothed part 3' which has excess thickness 37 or buildup 38 produced thereon in order to increase the precision of the tooth profile. A secondary pressing process can be performed on toothed part 3' having excess thickness 38 produced thereon, but buildup 38 is treated separately, because there are instances when buildup 38 is not suitable for a secondary pressing process. In the case of excess thickness 37, an excess thickness recess 11 can be provided on punch 1 prior to performing a primary pressing process so as not to increase the processing pressure as shown in FIG. 5(A), and an excess thickness recess 41 is also provided to counter 4 prior to each secondary pressing process, as shown in FIG. 5(B).

Figure 6C:
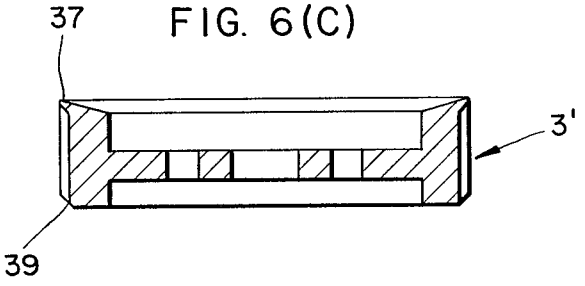
FIGS. 6(A)–6(D) are frontal elevation and cross sectional views showing the conditions under which the processes appropriate for the required degree of precision forming are selected.
Figure 6D:
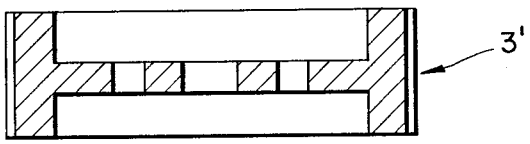
Figure 6A:
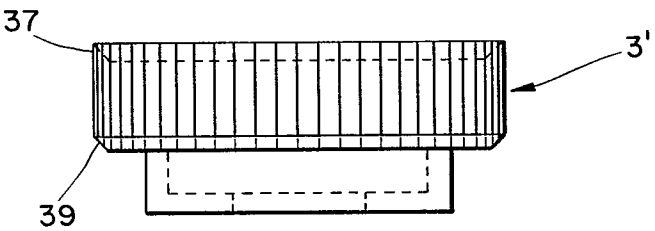
Figure 6B:
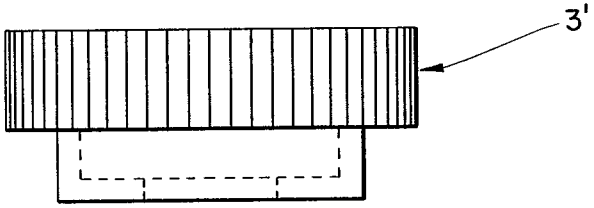

In cases when a round punch is not used, there is a method whereby shear drop 39 or excess thickness 37 is removed by machining or grinding after toothed part 3', which has a shear drop 39 or excess thickness 37 produced thereon as shown in FIGS. 6(A) and 6(C), is subjected to a primary pressing process, and a method whereby a primary pressing operation is performed so as to not result in the production of either shear drop or excess thickness as shown in FIGS. 6(B) and 6(D). In a case where high precision is not required for toothed part 3', it is desirable that toothed part 3' having shear drop 39 and excess thickness 37 produced thereon undergo a primary pressing process in order to reduce the surface pressure of punch 1 and improve the performance of die 2. When high precision is required for toothed part 3', the configuration of the punch is made to conform to the shapes of the die and the blank without spacing so as to avoid producing shear drop and excess thickness, and the counter is constructed without an excess thickness recess as previously described.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A process for manufacturing parts having a tooth profile and a boss, through use of a press machine, comprising the steps of:

providing a blank having a boss and a shape substantially similar to a finished product, said blank having been produced in a prior operation by machining, cold forging or warm forging;

pressing said blank with boss, which is in a top-to-bottom orientation, through a female die with a punch having a shape conforming to a top configuration of said blank with boss, the female die through which said blank with boss is passed having a tooth profile, a 20°-150 taper on upper and bottom inlets of the die and a mirrored surface on the upper and lower inlets of the die;

extruding said blank with boss toward a top of the female die from a downward position with a counter having a shape conforming to a bottom configuration of said blank with boss.

2. A process for manufacturing a part having a tooth profile and boss as claimed in claim 1 wherein the step of pressing said blank with a punch comprises the step of pressing said blank with a punch having a tooth profile provided thereon.

3. A process for manufacturing a part having a tooth profile and boss as claimed in claim 1 comprising a trimming taper removal operation which is performed on the aforesaid blank after an ironing process has been performed and the top-to-bottom orientation of said blank has been reversed.

4. A process for manufacturing a part having a tooth profile and boss as claimed in claim 1 wherein the step of pressing said blank with a punch comprises the step of pressing said blank with a round punch without a tooth profile formed thereon.

5. A process for manufacturing a part having a tooth profile and boss as claimed in claim 1 wherein the step of pressing said blank through a die comprises the step of pressing said blank with a punch having a tooth profile formed thereon, and said punch and counter have an excess thickness recess provided thereto prior to the operation.

* * * * *